US006546912B2

(12) United States Patent
Tuken

(10) Patent No.: US 6,546,912 B2
(45) Date of Patent: Apr. 15, 2003

(54) ON-LINE INDIVIDUAL FUEL INJECTOR DIAGNOSTICS FROM INSTANTANEOUS ENGINE SPEED MEASUREMENTS

(75) Inventor: Taner Tuken, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 39 days.

(21) Appl. No.: 09/798,360

(22) Filed: Mar. 2, 2001

(65) Prior Publication Data

US 2002/0148441 A1 Oct. 17, 2002

(51) Int. Cl.[7] ..... F02D 41/04; F02M 51/00
(52) U.S. Cl. ..... 123/436; 73/119 A; 701/111
(58) Field of Search ..... 123/436, 479; 701/103, 104, 110, 111; 73/116, 117.3, 119 A

(56) References Cited

U.S. PATENT DOCUMENTS

| | | | | |
|---|---|---|---|---|
| 3,919,885 A | | 11/1975 | Kaireit | |
| 4,061,025 A | | 12/1977 | Willenbecher et al. | |
| 4,292,670 A | | 9/1981 | Reid et al. | |
| 4,539,841 A | | 9/1985 | Schroeder | |
| 4,697,561 A | * | 10/1987 | Citron | 123/436 |
| 4,899,713 A | | 2/1990 | Nakamura | |
| 5,058,547 A | | 10/1991 | Morikawa | |
| 5,200,899 A | * | 4/1993 | Ribbens et al. | 701/111 |
| 5,239,473 A | * | 8/1993 | Ribbens et al. | 123/436 |
| 5,241,933 A | | 9/1993 | Morikawa | |
| 5,278,760 A | * | 1/1994 | Ribbens et al. | 123/436 |
| 5,495,415 A | * | 2/1996 | Ribbens et al. | 123/436 |
| 5,535,621 A | | 7/1996 | Glidewell et al. | |
| 5,576,963 A | * | 11/1996 | Ribbens et al. | 123/436 |
| 6,021,758 A | * | 2/2000 | Carey et al. | 123/436 |

FOREIGN PATENT DOCUMENTS

GB 2 245 382 A 2/1992

* cited by examiner

*Primary Examiner*—Willis R. Wolfe
(74) *Attorney, Agent, or Firm*—Woodard, Emhardt, Naughton, Moriarty & McNett

(57) ABSTRACT

Manufacturing imperfections and component failures in the fuel system of an engine, can lead to non-uniform torque production among the cylinders. Non-uniform cylinder torques can be observed as small engine speed fluctuations about the average engine speed at any given operating point. Engine speed data contains fluctuations at different frequencies. The amplitude of fluctuations at some known frequencies tell about the health of the fuel injectors and the engine. In the present invention, the instantaneous engine speed data is filtered by discrete second-order band-pass filters to find the engine speed fluctuations at particular frequencies. The output of the filters is identical to power spectral density of speed signal at those frequencies. The amplitude of each filter output is then compared to a predetermined threshold value. If the amplitude is bigger than this threshold, it indicates the existence of low fueling or high fueling fuel injectors. If the amplitude is bigger than a second higher threshold, it indicates the existence of dead fuel injectors.

43 Claims, 10 Drawing Sheets

(ff=firing frequency)

ON-LINE INDIVIDUAL FUEL INJECTOR DIAGNOSTICS FROM INSTANTANEOUS ENGINE SPEED MEASUREMENTS

TECHNICAL FIELD OF THE INVENTION

The present invention generally relates to engine control systems and, more particularly, to a method and apparatus for diagnosing dead fuel injectors and correcting unbalanced fuel injectors.

BACKGROUND OF THE INVENTION

In a multi-cylinder reciprocating internal combustion engine, there are differences in the amount of useful torque produced by each cylinder, even during normal operation. Small between-cylinder torque differences can cause rough idling and poor emissions performance. Large between-cylinder differences can cause extremely rough operation and may indicate faulty cylinder and/or fuel injection components. The process of sensing these torque differences and using the information for compensation or diagnosis of engine operation is known as cylinder balancing.

Most present day electronically controlled engines include some form of interrupt-based engine speed sensing mechanism, which allows measurement of engine speed at very short intervals. Although there have been prior art systems which try to diagnose fuel injector malfunction off-line or when the engine is not running, they have generally proven to be unsatisfactory. There is therefore a need for a method and apparatus for diagnosing and correcting malfunctioning fuel injectors and unbalanced cylinders while the engine is on-line or running. The present invention is directed toward meeting this need.

SUMMARY OF THE INVENTION

Manufacturing/design imperfections and component failures in the fuel system/engine can lead to non-uniform torque production among the engine cylinders. Non-uniform cylinder torques can be observed as small engine speed fluctuations about the average engine speed at any given operating point. Engine speed data contains such fluctuations at different frequencies. The amplitude of these speed fluctuations at some known frequencies tell about the health of the fuel injectors and the engine. In the present invention, the instantaneous engine speed data is filtered by discrete band-pass filters to produce the engine speed fluctuations at particular frequencies. The output of the filters is identical to the power spectral density of the speed signal at those frequencies. The amplitude of each filter output is then compared to a user-defined threshold value. An amplitude larger than this threshold indicates the existence of low-fueling or high-fueling fuel injectors. If the amplitude is bigger than a second higher threshold, then this indicates the existence of dead fuel injectors.

In one form of the invention, a method for diagnosing malfunctioning fuel injectors is disclosed, comprising the steps of: a) sensing a speed of the engine a plurality of times during a time period; b) filtering the sensed engine speed, thereby producing engine speed fluctuation data at predetermined frequencies corresponding to specific fuel injectors; c) generating a fault code for fuel injectors with engine speed fluctuations exceeding a predetermined threshold.

In another form of the invention, a method for diagnosing malfunctioning fuel injectors is disclosed, comprising the steps of: a) sensing a speed of the engine a plurality of times during a time period; b) filtering the sensed engine speed, thereby producing engine speed fluctuation data at predetermined frequencies corresponding to specific fuel injectors; c) performing a program correcting the fuel injectors with engine speed fluctuations exceeding a predetermined threshold.

In another form of the invention, a method for engine cylinder balancing and diagnosing dead fuel injectors is disclosed, comprising the steps of: a) sensing a speed of the engine a plurality of times during a time period; b) filtering the sensed engine speed, thereby producing engine speed fluctuation data at predetermined frequencies corresponding to a specific fuel injector; c) comparing the filtered engine speed fluctuations to a first predetermined threshold value; d) comparing the engine speed fluctuations to a second predetermined threshold value when the engine speed fluctuations did not satisfy the threshold conditions in step (c); e) if the engine speed fluctuations did not satisfy the threshold conditions in step (d); performing steps (e.1) through (e.4); e.1) resetting all fuel injector trims to a predetermined value and calculating the total engine speed fluctuation; e.2) for a first one of the plurality of fuel injectors reducing fuel injector fueling by a predetermined value and calculating a new total engine speed fluctuation; e.3) generating a fault code for the first fuel injector when the calculated engine speed fluctuations from steps (e.1) and (e.2) are equal; e.4) repeating steps (e.1) through (e.3) for each remaining fuel injector; (f) if the engine speed fluctuations satisfy the threshold conditions in step (d); performing steps (f.1) through (f.3); f.1) adjusting the trim for the first fuel injector and calculating the total engine speed fluctuation; f.2) readjusting the trim for the first fuel injector until the calculated total engine speed fluctuation is at a local minimum; f.3) repeating steps (f.1) through (f.2) for all fuel injectors; g) generating fault codes corresponding to adjustments made to each of the fuel injectors.

DETAILED DESCRIPTION OF THE PREFERRED EMBODIMENT

Figure 1:
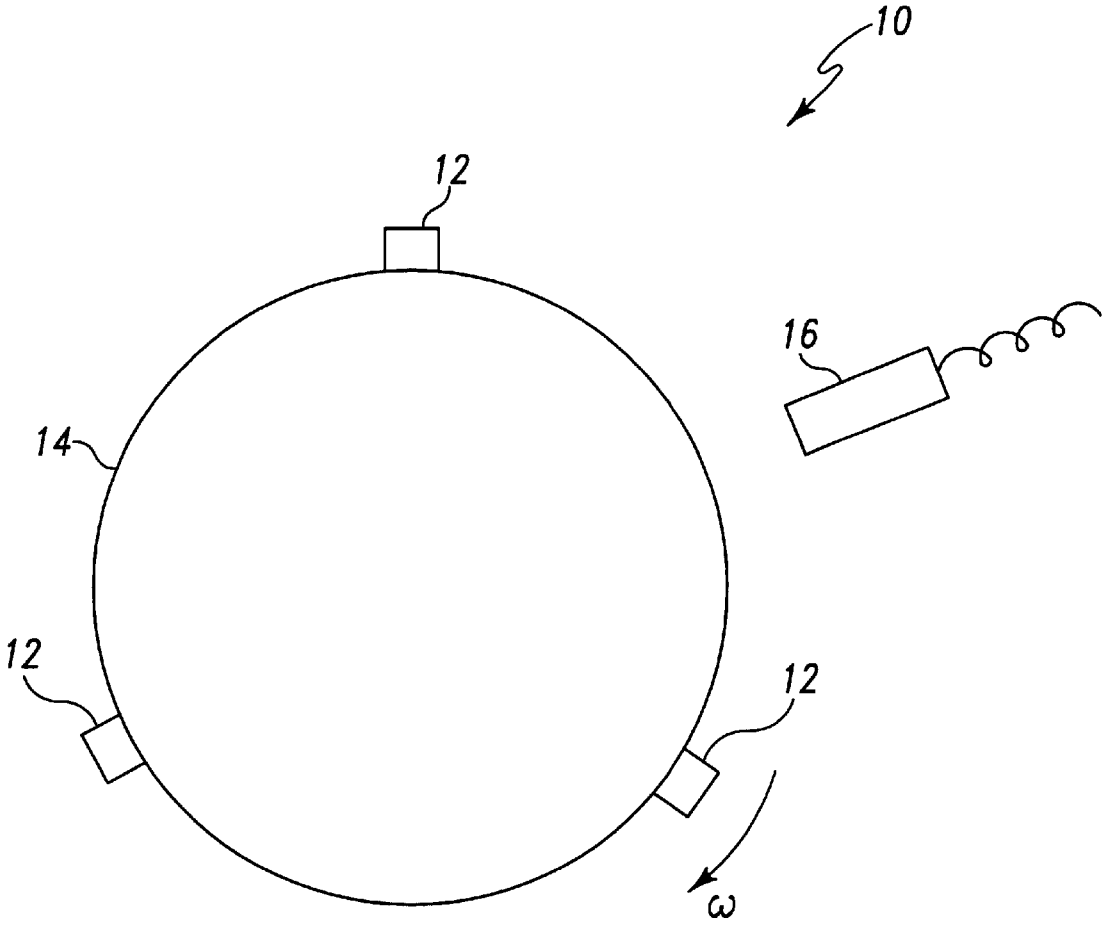
FIG. 1 is a schematic diagram of a prior art engine speed sensor.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein being contemplated as would normally occur to one skilled in the art to which the invention relates.

The present invention utilizes the detection of non-uniform cylinder torques as small observed engine speed fluctuations about the average engine speed for any given operating point of the engine. Therefore, the method and apparatus of the present invention utilizes the sensing of engine speed by any convenient means. FIG. 1 illustrates a typical prior art engine speed sensor, indicated generally at 10. Ferrous targets 12 are placed at fixed angular positions upon a rotating shaft 14, such as a crankshaft or camshaft, which rotates at a fixed relative speed to the engine speed. An appropriate sensor 16, such as a Hall effect sensor is placed so as to sense the passing of each of the targets 12 and to generate an output signal in the response thereto. This output signal is generally applied as an interrupt to a microprocessor such that the microprocessor can measure the time delay between successive outputs from the sensor 16 (and therefore also successive passings of the target 12). Those having ordinary skill in the art will recognize that the engine speed sensor 10 is illustrated by way of example only, and that there may be many different known methods for measuring engine speed.

In the preferred embodiment of the present invention, the output of the sensor 16 of FIG. 1 is coupled to an interrupt input port of an engine control module (ECM) microprocessor (not shown). It will be appreciated by those having ordinary skill in the art that nearly all modem engines incorporate a microprocessor-based ECM in order to manage various engine functions. It is intended that the process of the present invention be implemented as software code stored in a memory associated with such ECM microprocessor, the software code being executed by the microprocessor as described herein.

Figure 2:
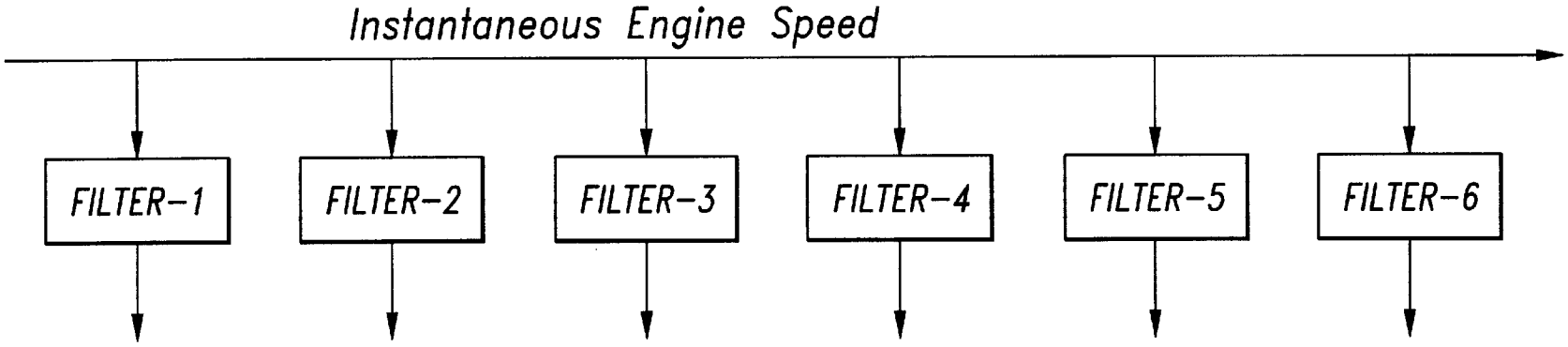
FIG. 2 is a schematic block diagram of a first embodiment filter system of the present invention.

As shown in FIG. 2, the engine speed data collected by the ECM is filtered to determine the speed fluctuations at selected frequencies. In the preferred embodiment discrete second-order band-pass filters are used. It will be appreciated by those having ordinary skill in the art that other variations of band-pass filters could also be used such as third-order band-pass filters. Below is an example of the discrete second-order band-pass filter used in the preferred embodiment.

$$H(z) = \frac{\cos(\Psi)z^2 - \gamma\cos(\omega T - \Psi)z}{z^2 - 2\gamma\cos(\omega T)z + \gamma^2}$$

where, $\Psi$ and $\gamma$ are filter design parameters, $\omega$ is the frequency of interest (rad/sec), and T is the sampling period (sec). The output of the filters is identical to the power spectral density of the speed signal at the filtered frequencies.

Figure 3:
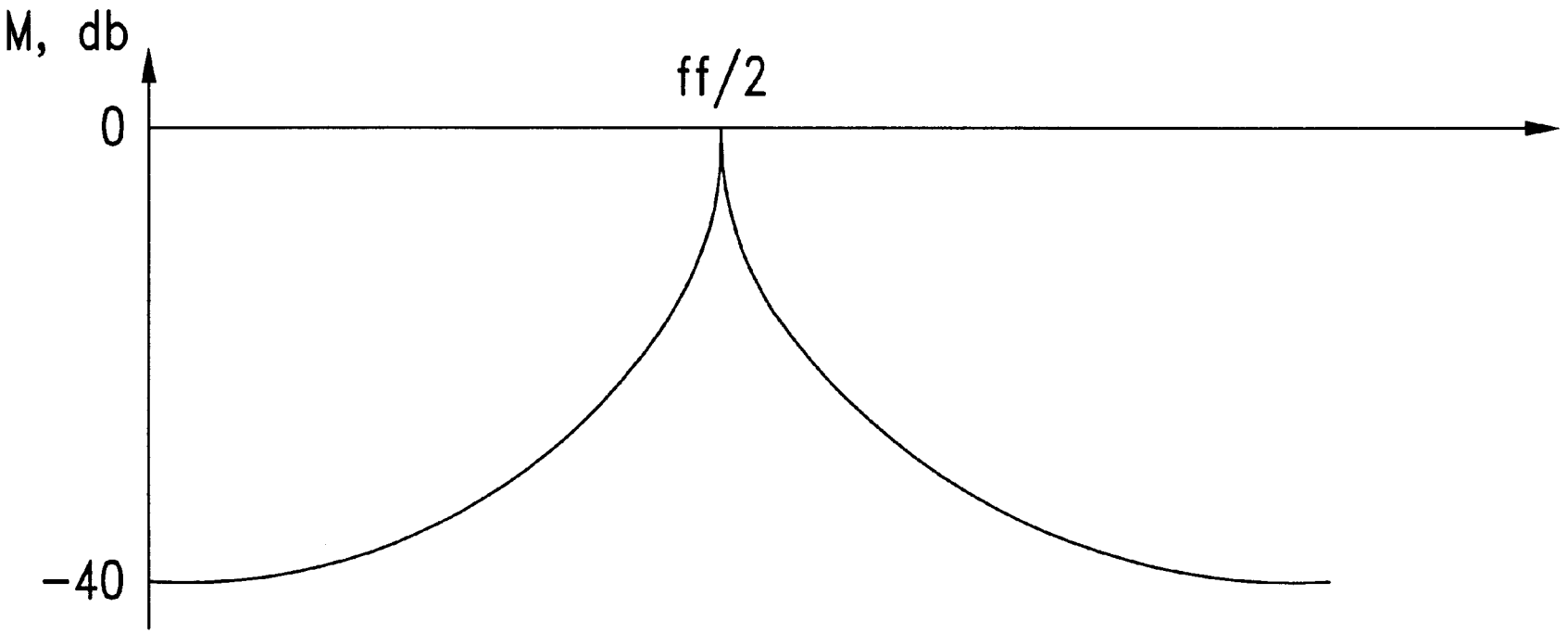
FIG. 3 is a graph of the frequency response of a discrete second-order band-pass filter used to calculate the spectral energy at half of the firing frequency.

In the preferred embodiment there is one filter for each cylinder of the engine. Each filter corresponds to a fuel injector for a particular cylinder. For example, a six cylinder engine will usually have six filters although more filters could be used. For a six cylinder engine, the filtered frequencies will be 1/6, 2/6, 3/6, 4/6, 5/6, and 6/6 times the firing frequency. The frequency filtered at 1/6 times the firing frequency corresponds to the fuel injector of the cylinder that fires first in the firing sequence of the engine. In the preferred embodiment a six cylinder engine is used. An example of the output of the filter of FIG. 2 having a filtered frequency of ½ the firing frequency is shown in FIG. 3. It will be appreciated by those having ordinary skill in the art that an engine having any number of cylinders could be used. For example, an eight cylinder engine would filter frequencies 1/8, 2/8, 3/8, 4/8, 5/8, 6/8, 7/8, and 8/8 times the firing frequency and a four cylinder engine would filter frequencies 1/4, 2/4, 3/4, and 4/4 times the firing frequency.

Figure 4:
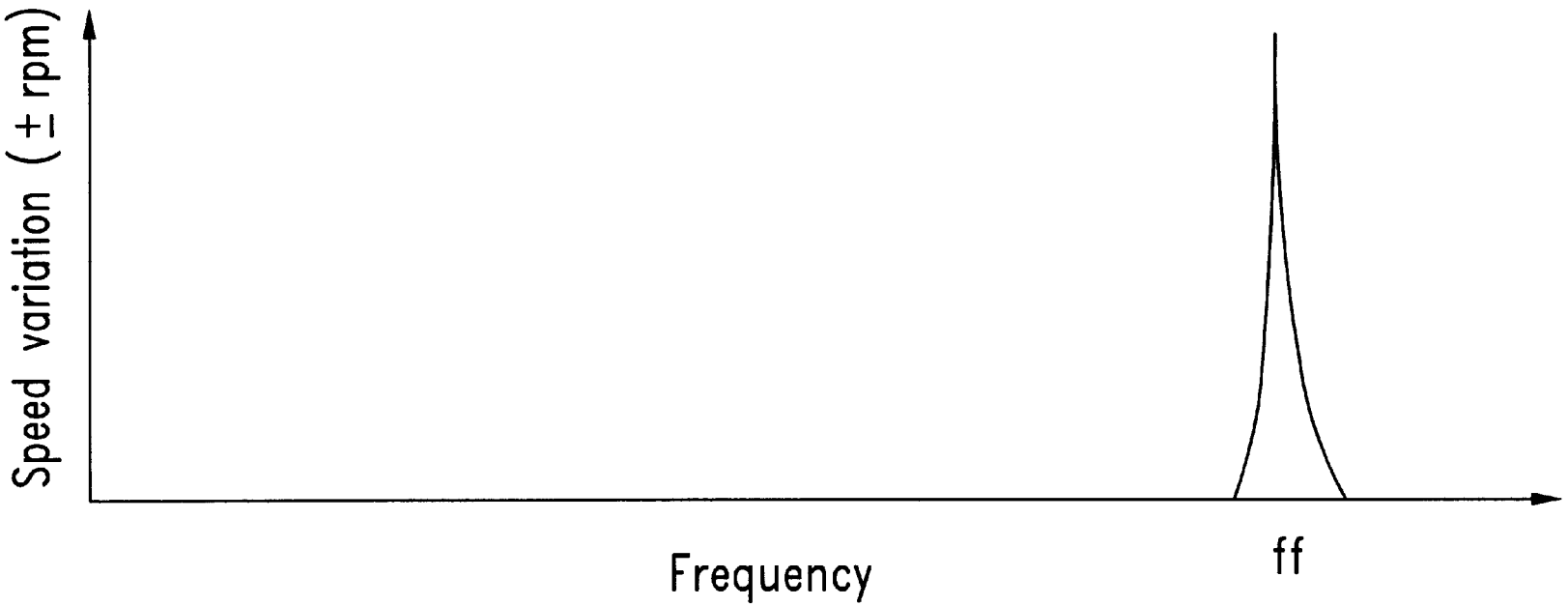
FIG. 4 is a graph of engine speed variation (in revolutions per minute) versus frequency for a theoretical healthy engine.

FIG. 4 illustrates a graph of engine speed variation (in revolutions per minute) versus firing frequency that can be generated using the filtered engine speed. The graph shown in FIG. 4 illustrates the filtered engine speed fluctuations of a theoretical perfectly healthy engine. There is no variation in engine speed because each fuel injector is providing exactly the same amount of fuel. The only engine speed variation occurs at the firing frequency. This is the peak which occurs at "ff". This is due to the inevitable discrete nature of the combustion process.

Figure 5:
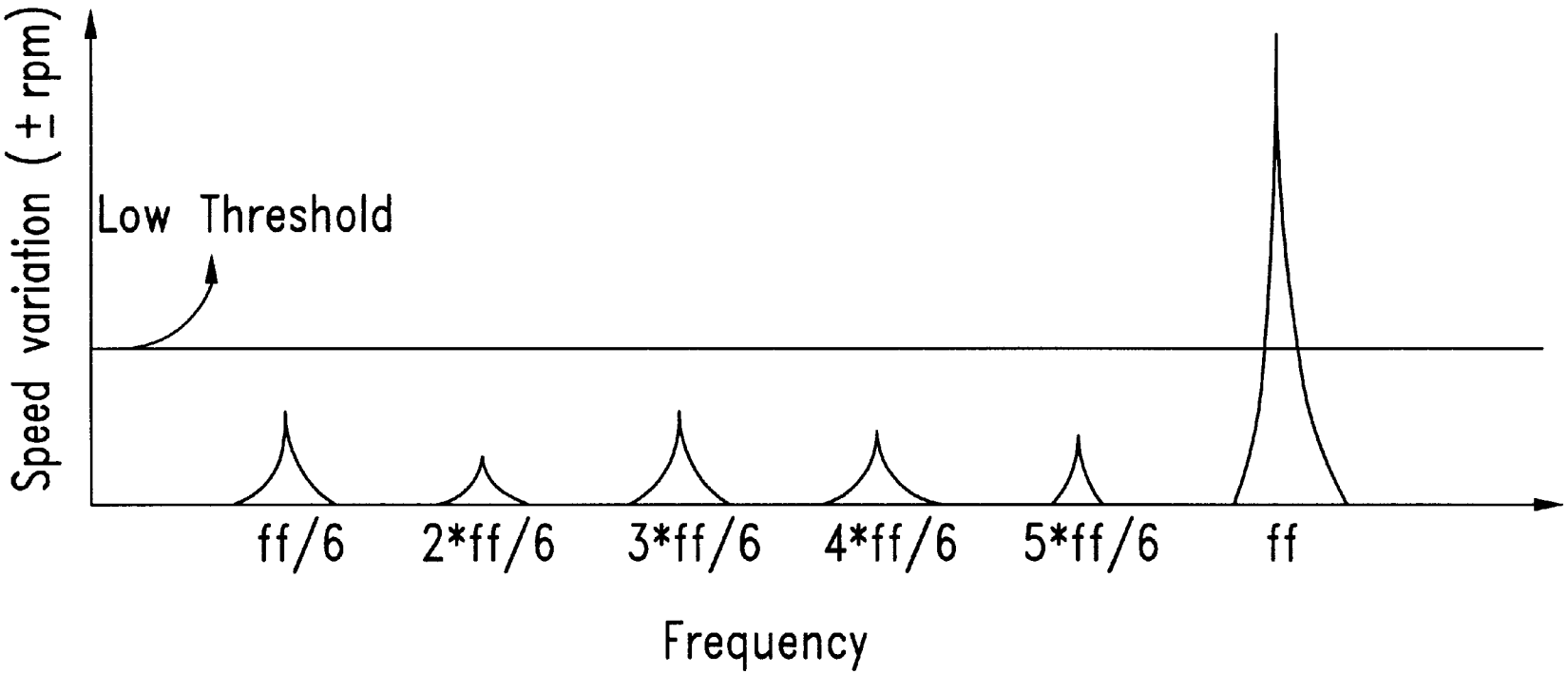
FIG. 5 is a graph of engine speed variation (in revolutions per minute) versus frequency for a real-life healthy engine.

FIG. 5 illustrates a graph of engine speed variation (in revolutions per minute) versus firing frequency for a normal healthy engine. Due to manufacturing tolerances, in real life, the fuel injectors will usually not be identical to each other. Therefore, each fuel injector may deliver a slightly different amount of fuel during an injector event. A cylinder having excess fuel injected into it will have a greater power contribution than a cylinder having less fuel delivered to it. A cylinder having too little fuel injected into it will not deliver as much power as cylinders with the appropriate amount of fuel injected. This over and under fueling causes speed variations in the engine. As can be seen on the graph, the speed variation at the six filtered frequencies differs slightly, but not significantly.

Figure 6:
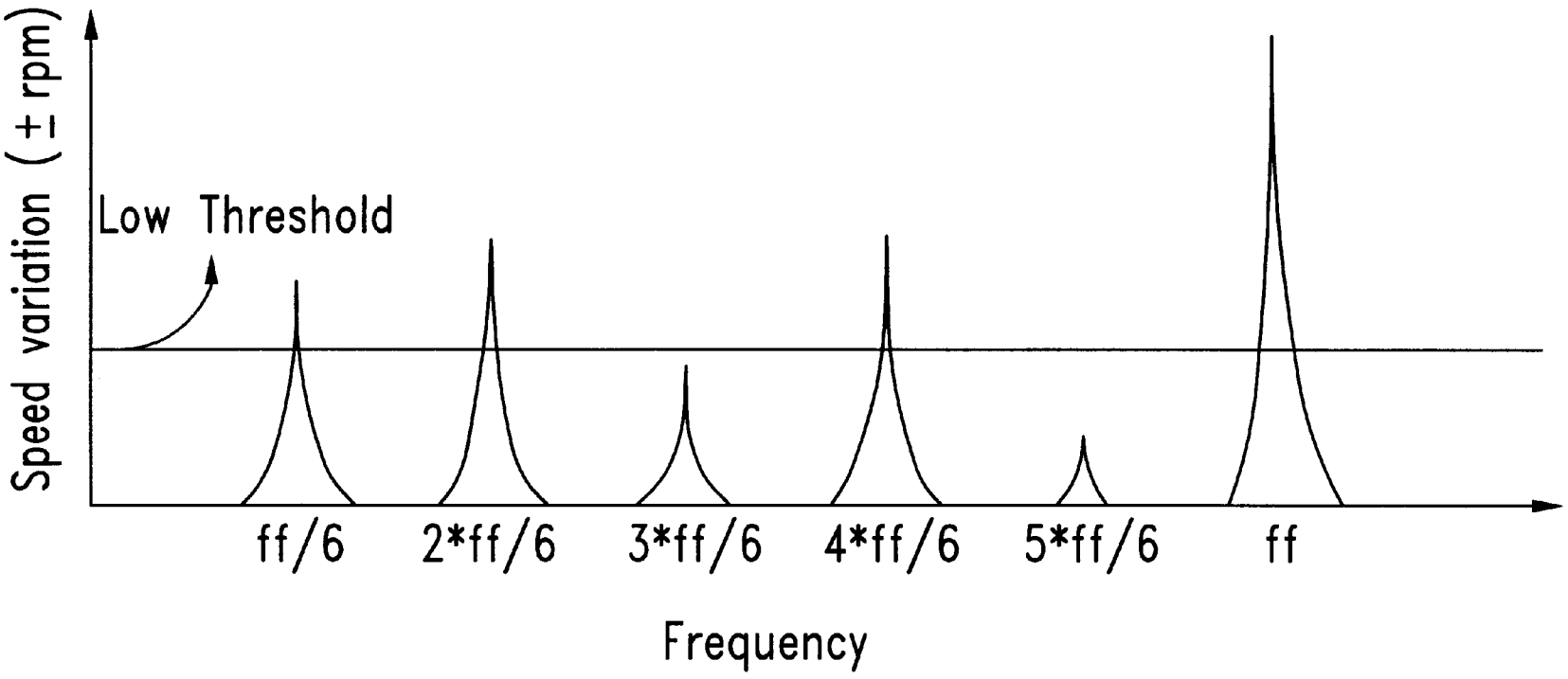
FIG. 6 is a graph of engine speed variation (in revolutions per minute) versus frequency for an engine with uneven fuel injectors.

FIG. 6 illustrates a graph of engine speed variation (in revolutions per minute) versus the frequency for an engine with unbalanced cylinders. A predetermined amount of engine speed variation may be designated on the graph by the "Low threshold" line, corresponding to a maximum amount of tolerable engine speed variation. The graph indicates that the speed variation for cylinders 1, 2 and 4 exceed the predetermined lower threshold. This indicates that the fuel injectors for these cylinders are supplying either an excessive or an inadequate amount of fuel to their respective cylinders. When one of the cylinder speed variations is above the predetermined low threshold, the ECM will run a fuel injector balancing program, as discussed herein below.

Figure 7:
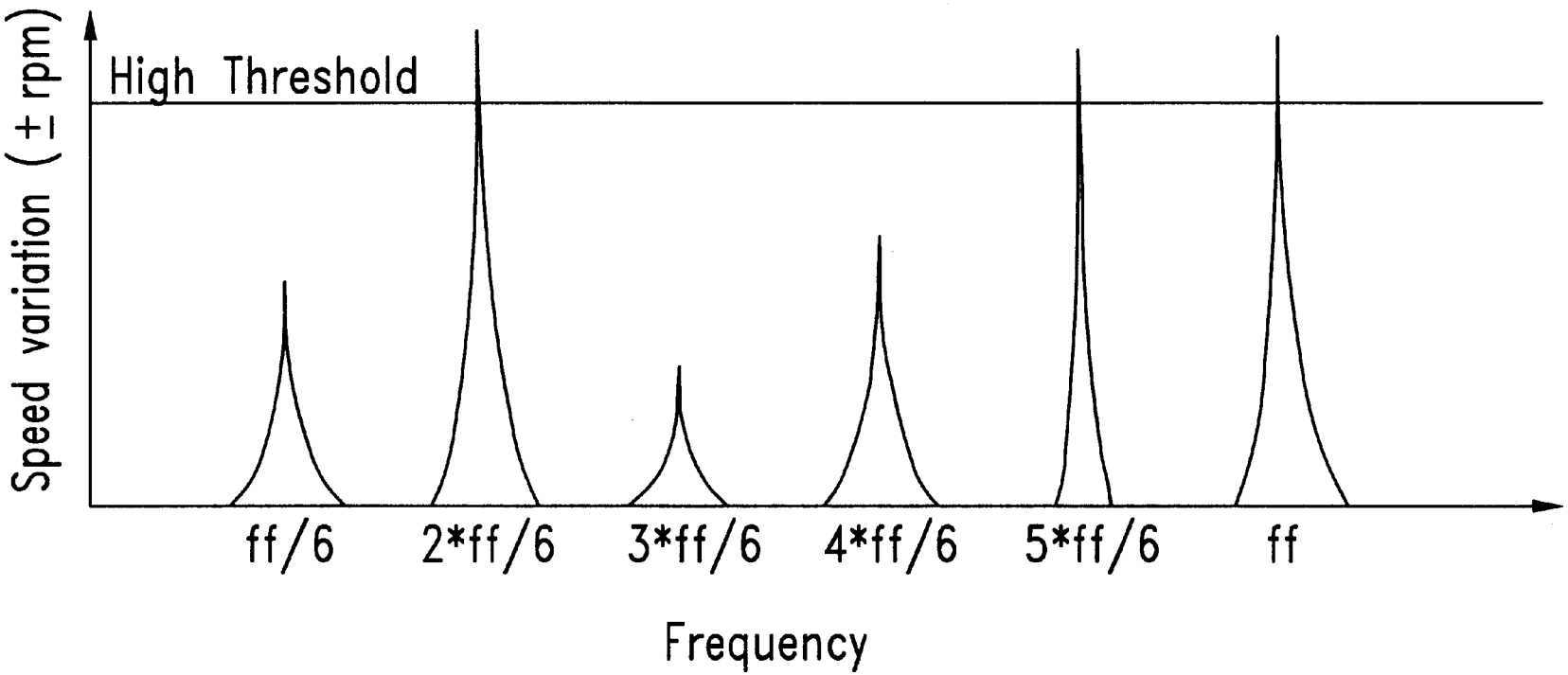
FIG. 7 is a graph of engine speed variation (in revolutions per minute) versus frequency for an engine with one or more dead fuel injectors.

FIG. 7 illustrates a graph of engine speed variation (in revolutions per minute) versus firing frequency for an engine with one or more dead fuel injectors. This graph is similar to the graph shown in FIG. 6, but the predetermined threshold is higher in FIG. 7. The second threshold can be set to a value that will indicate the presence for a dead fuel injector. If a speed variation of a cylinder is above the high threshold, a dead fuel injector exists. Fuel injectors 2 and 5 on the graph of FIG. 7 have speed variations which exceed the high threshold value. These fuel injectors are malfunctioning and should be repaired. If a speed variation of a cylinder is above the high threshold, the ECM will run a program which will determine which fuel injector is defective, as discussed in greater detail herein below.

Figure 8:
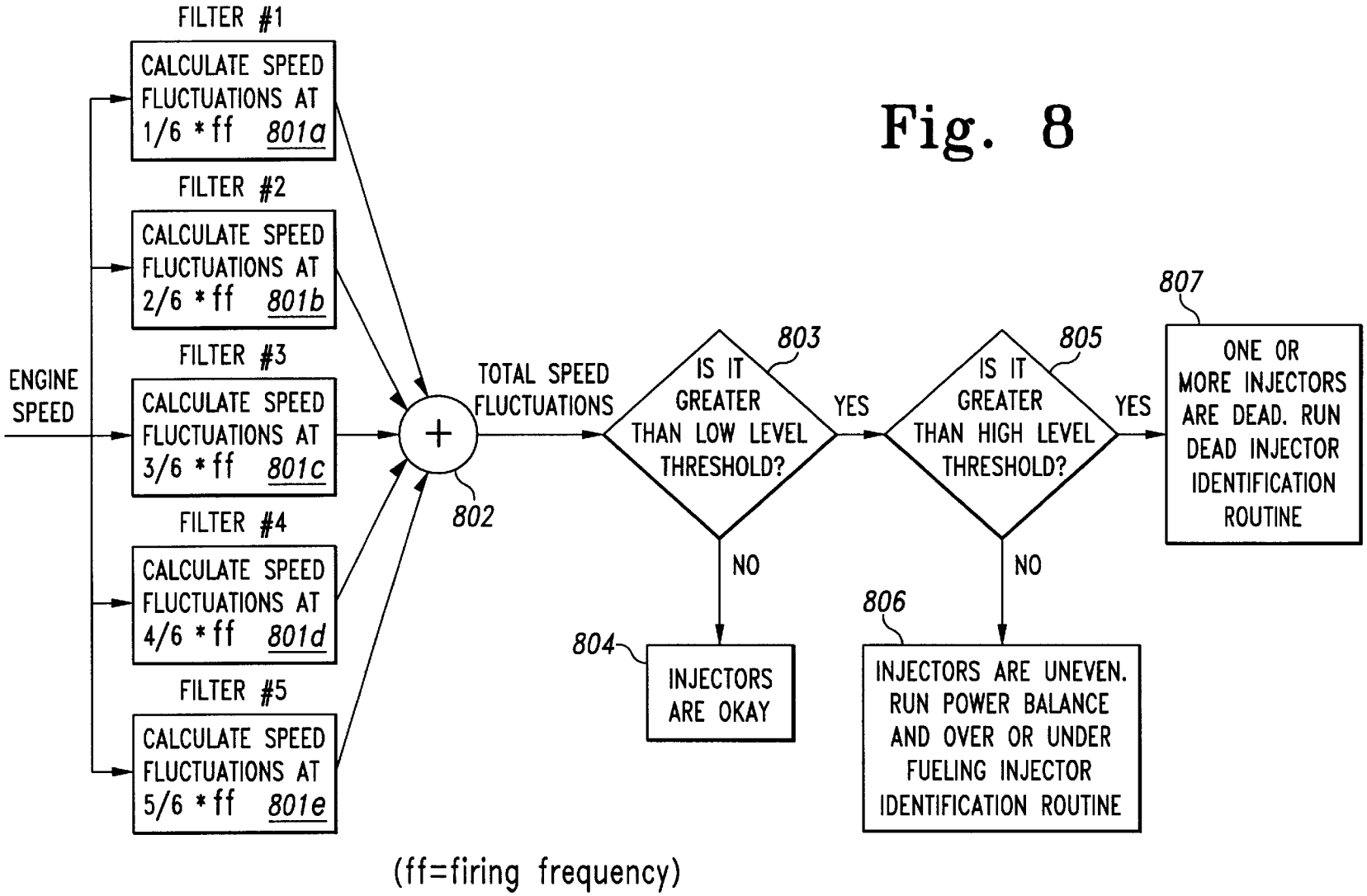
FIG. 8 is a schematic block diagram of a fuel injector diagnostics routine of the present invention.

FIG. 8 is a flow chart of the fuel injector diagnostics program. The sensed instantaneous engine speed is input to the filters at steps 801(*a–e*) to determine the engine speed variation at the designated frequencies. The filtered engine speed data is combined at step 802 which produces the total engine speed fluctuation. The engine speed variations are compared to a lower level threshold at step 803. If no speed variation is greater than the lower threshold, the process proceeds to step 804 which indicates that all fuel injectors are performing correctly and the engine is healthy. If any of the speed variations are determined at step 803 to be greater than the lower threshold, the ECM then compares the speed variations to a predetermined higher level threshold at step 805. If there is no speed variation above the higher level threshold, at step 806 the ECM runs a fuel injector balancing program. If any of the speed variations are above the high level threshold, the ECM runs a dead fuel injector identification routine at step 807.

Figure 9:
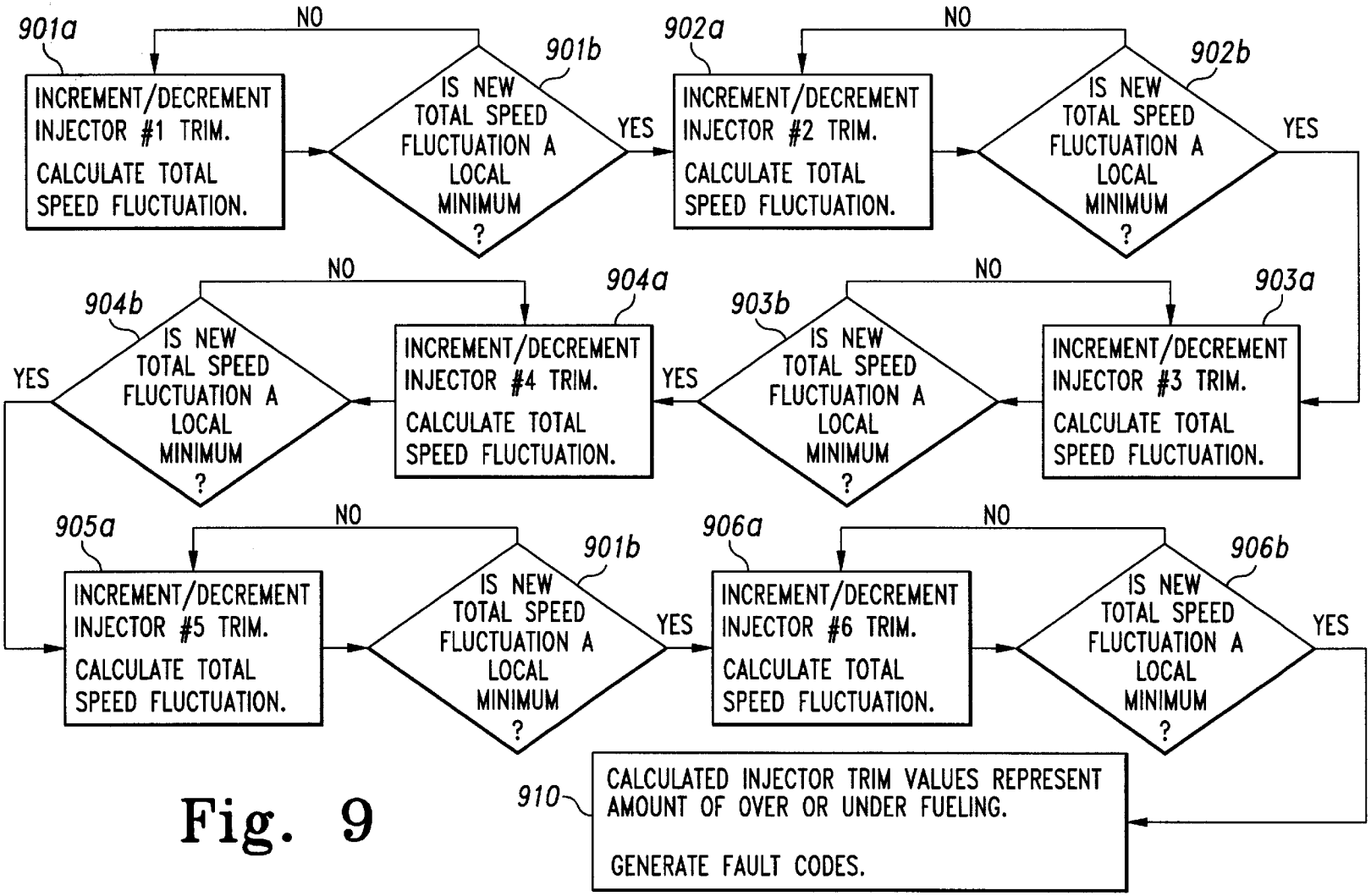
FIG. 9 is a schematic block diagram of a cylinder balancing routine of the present invention.

FIG. 9 illustrates a flowchart of the cylinder balancing program discussed above. At step 901*a*, the program increases or decreases the trim of a first fuel injector and calculates the total speed fluctuation caused by the trim adjustment. The program then determines if the speed fluctuation is a local minimum at step 901*b*. If the speed fluctuation is at a local minimum at step 901*b*, the program begins adjusting the trim of the next fuel injector at step 902*a* until the new total speed fluctuation is at a local minimum at step 902*b*. If the speed fluctuation at step 901*b* is not at a local minimum the program readjusts the trim at step 901*a*. The process of adjusting the trim (steps 903*a*, 904*a*, 905*a*, and 906*a*) until the new total speed fluctuation is at a local minimum (steps 903*b*, 904*b*, 905*b*, and 906*b*) is repeated for each fuel injector. After the trim for each fuel injector has been calculated the ECM generates a fault code corresponding to the adjustments made to the fuel injectors at step 910.

Figure 10:
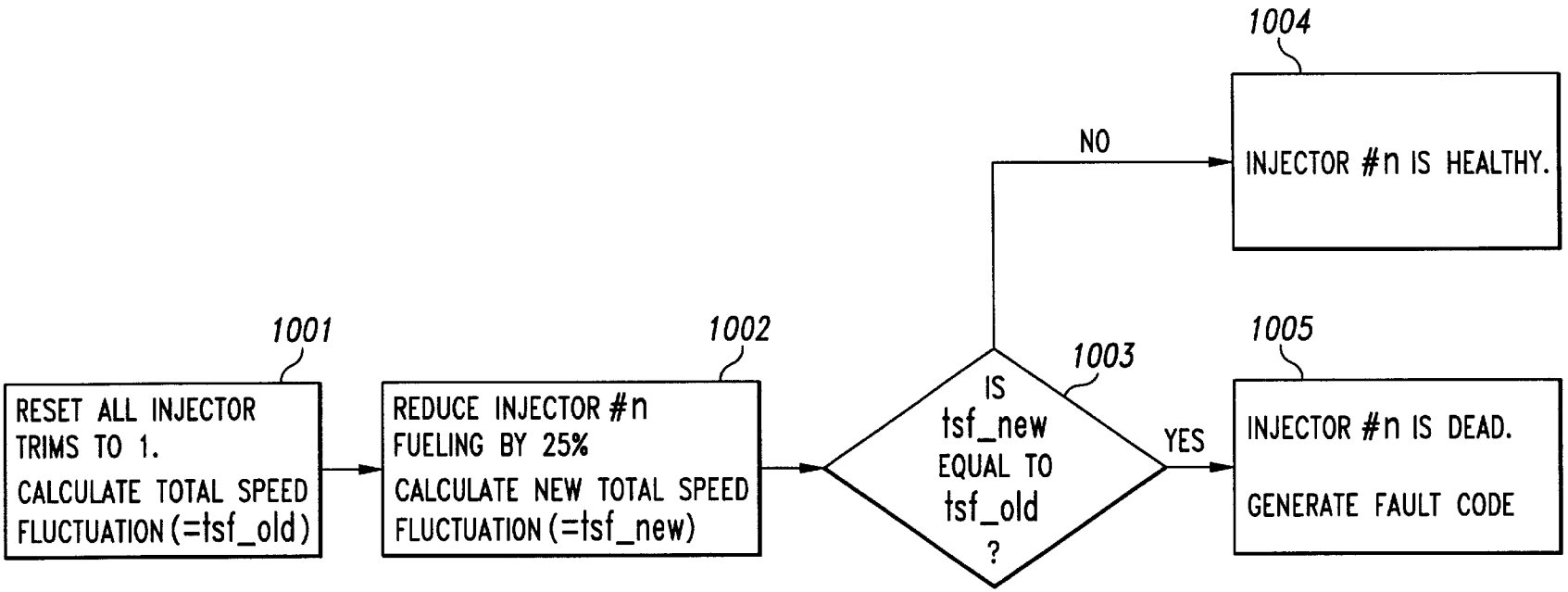
FIG. 10 is a schematic block diagram of a dead fuel injector identification routine of the present invention.

FIG. 10 illustrates the dead fuel injector identification routine discussed above. The program is preferably only used if the speed variation at a cylinder is above the higher level threshold. The program begins at step 1001 by resetting all fuel injector trims to one and calculating the total speed fluctuation this action causes. The program then reduces the first fuel injector fueling by a predetermined amount and calculates a new total speed fluctuation at step 1002. In the preferred embodiment the fuel injector fueling is reduced by 25%. At step 1003 the computer compares the speed fluctuation caused by resetting the fuel injector trims to one to the speed fluctuation caused by reducing the first fuel injector fueling by 25%. If the speed fluctuations are equal, this indicates the fuel injector is dead and a fault code is generated at step 1005. If the speed variations are not equal the fuel injector is healthy and the program proceeds to step 1004. This routine is repeated for each fuel injector.

Those having skill in the art will therefore appreciate that, in the present invention, the instantaneous engine speed data is filtered to produce the engine speed fluctuations at particular frequencies. The amplitude of each filter output is compared to a predetermined threshold value. An amplitude larger than this threshold indicates the existence of low-fueling or high-fueling fuel injectors. If the amplitude is bigger than a second higher threshold, then this indicates the existence of dead fuel injectors. The present invention therefore diagnoses dead injectors and balances misfiring cylinders while the engine is on-line or running, representing a significant improvement over prior art off-line systems.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, while the present invention has been described hereinabove with respect to a six cylinder engine, those having ordinary skill in the art will recognize that the processes described hereinabove are equally applicable to engines having fewer or greater numbers of cylinders.

What is claimed:

1. A method for cylinder balancing of an engine having a plurality of fuel injectors, comprising the steps of:

a. sensing a speed of the engine a plurality of times during a time period;

b. filtering the sensed engine speed, thereby producing engine speed fluctuation data at predetermined frequencies corresponding to respective ones of the plurality of fuel injectors;

c. comparing the filtered engine speed fluctuations to a first predetermined threshold value;

d. comparing the engine speed fluctuations to a second predetermined threshold value when the engine speed fluctuations did not satisfy the threshold conditions in step (c);

e. if the engine speed fluctuations did not satisfy the threshold conditions in step (d); performing steps e.1 through e.4;

e.1 resetting all fuel injector trims to a predetermined value and calculating the total engine speed fluctuation;

e.2 for a first one of the plurality of fuel injectors reducing fuel injector fueling by a predetermined value and calculating a new total engine speed fluctuation;

e.3 generating a fault code for the first fuel injector when the calculated engine speed fluctuations from steps (e.1) and (e.2) are equal;

e.4 repeating steps (e.1) through (e.3) for each remaining fuel injector;

f. if the engine speed fluctuations satisfy the threshold conditions in step (d); performing steps f.1 through f.3;

f.1 adjusting the trim for the first fuel injector and calculating the total engine speed fluctuation;

f.2 readjusting the trim for the first fuel injector until the calculated total engine speed fluctuation is at a local minimum;

f.3. repeating steps (f.1) through (f.2) for all fuel injectors; and g. generating fault codes corresponding to adjustments made to each of the fuel injectors.

2. The method of claim 1, wherein the method terminates if the threshold in step (c) is satisfied.

3. The method of claim 1, wherein step (b) uses band-pass filters to filter the sensed engine speed.

4. The method of claim 1, wherein step (b) uses discrete second-order band-pass filters to filter the sensed engine speed.

5. The method of claim 1, wherein step (b) uses third-order band-pass filters to filter the sensed engine speed.

6. The method of claim 1, wherein the predetermined frequencies at are $1/6$, $2/6$, $3/6$, $4/6$, $5/6$, and $6/6$ times a firing frequency of the engine.

7. The method of claim 1, wherein the predetermined frequencies are $1/8$, $2/8$, $3/8$, $4/8$, $5/8$, $6/8$, $7/8$, and $8/8$ times a firing frequency of the engine.

8. The method of claim 1, wherein the predetermined frequencies are $1/4$, $2/4$, $3/4$, and $4/4$ times a firing frequency of the engine.

9. The method of claim 1, wherein if the threshold conditions of step (d) are satisfied a routine is performed to determine which ones of the plurality of fuel injectors are malfunctioning.

10. The method of claim 1, wherein if the threshold conditions of step (d) are not satisfied a routine is performed to balance the cylinders.

11. The method of claim 1, wherein step (a) further comprises of sensing the engine speed with a Hall effect sensor.

12. A method for diagnosing engine fuel injector failure on-line, comprising the steps of:

a. sensing a speed of the engine a plurality of times during a time period;

b. filtering the sensed engine speed data, thereby producing engine speed fluctuation data at predetermined frequencies corresponding to specific fuel injectors; and c. generating a fault code for fuel injectors with engine speed fluctuations exceeding a predetermined threshold value;

wherein the predetermined threshold is substantially lower than speed fluctuations caused by cylinder misfires.

13. The method of claim 12, wherein step (b) uses band-pass filters to filter the sensed engine speed.

14. The method of claim 12, wherein step (b) uses discrete second-order band-pass filters to filter the sensed engine speed.

15. The method of claim 12, wherein step (b) uses third-order band-pass filters to filter the sensed engine speed.

16. The method of claim 12, wherein the predetermined frequencies at are 1/6, 2/6, 3/6, 4/6, 5/6, and 6/6 times a firing frequency of the engine.

17. The method of claim 12, wherein the predetermined frequencies are 1/8, 2/8, 3/8, 4/8, 5/8, 6/8, 7/8, and 8/8 times a firing frequency of the engine.

18. The method of claim 12, wherein the predetermined frequencies are 1/4, 2/4, 3/4, and 4/4 times a firing frequency of the engine.

19. The method of claim 12, wherein step (a) further comprises sensing the engine speed with a Hall effect sensor.

20. The method of claim 12, wherein step (b) further comprises of comparing the filtered engine speed fluctuations to the predetermined threshold value.

21. The method of claim 20, wherein the method terminates if the threshold in claim 13 is satisfied.

22. The method of claim 20, wherein the engine speed fluctuations are compared to a second threshold value when the engine speed fluctuations did not satisfy the threshold conditions in claim 20.

23. The method of claim 22, further comprising performing the following steps if the engine speed fluctuations did not satisfy the threshold conditions in claim 14:

d.1 resetting all fuel injector trims to a predetermined value and calculating the total engine speed fluctuation;

d.2 for a first one of the plurality of fuel injectors reducing fuel injector fueling by a predetermined value and calculating a new total engine speed fluctuation;

d.3 generating a fault code for the first fuel injector when the calculated engine speed fluctuations from steps (d.1) and (d.2) are equal;

d.4 repeating steps (d.1) through (d.3) for each remaining fuel injector.

24. The method of claim 22, wherein if the threshold conditions of claim 14 are satisfied a routine is performed to determine which ones of the plurality of fuel injectors are malfunctioning.

25. The method of claim 22, wherein if the threshold conditions of claim 14 are not satisfied a routine is performed to balance the cylinders.

26. The method of claim 22, further comprising performing the following steps if the engine speed fluctuations satisfy the threshold conditions in claim 22:

d.1 adjusting the trim for the first fuel injector and calculating the total engine speed fluctuation;

d.2 readjusting the trim for the first fuel injector until the calculated total engine speed fluctuation is at a local minimum;

d.3. repeating steps (d.1) through (d.2) for all fuel injectors.

27. The method of claim 26, wherein fault codes corresponding to adjustments made to each of the injectors are generated.

28. A method for diagnosing engine fuel injector failure on-line, comprising the steps of:

a. sensing a speed of the engine a plurality of times during a time period;

b. filtering the sensed engine speed data, thereby producing engine speed fluctuation data at predetermined frequencies corresponding to specific fuel injectors; and c. performing a program to correct the fuel injectors with engine speed fluctuations exceeding a predetermined threshold value.

29. The method of claim 28, wherein step (b) uses band-pass filters to filter the sensed engine speed.

30. The method of claim 28, wherein step (b) uses discrete second-order band-pass filters to filter the sensed engine speed.

31. The method of claim 28, wherein step (b) uses third-order band-pass filters to filter the sensed engine speed.

32. The method of claim 28, wherein the predetermined frequencies at are 1/6, 2/6, 3/6, 4/6, 5/6, and 6/6 times a firing frequency of the engine.

33. The method of claim 28, wherein the predetermined frequencies are 1/8, 2/8, 3/8, 4/8, 5/8, 6/8, 7/8, and 8/8 times a firing frequency of the engine.

34. The method of claim 28, wherein the predetermined frequencies are 1/4, 2/4, 3/4, and 4/4 times a firing frequency of the engine.

35. The method of claim 28, wherein step (a) further comprises sensing the engine speed with a Hall effect sensor.

36. The method of claim 28, wherein step (b) further comprises of comparing the filtered engine speed fluctuations to a predetermined threshold value.

37. The method of claim 36, wherein the method terminates if the threshold in claim 13 is satisfied.

38. The method of claim 36, wherein the engine speed fluctuations are compared to a second threshold value when the engine speed fluctuations did not satisfy the threshold conditions in claim 36.

39. The method of claim 38, further comprising performing the following steps if the engine speed fluctuations did not satisfy the threshold conditions in claim 30:

d.1 resetting all fuel injector trims to a predetermined value and calculating the total engine speed fluctuation;

d.2 for a first one of the plurality of fuel injectors reducing fuel injector fueling by a predetermined value and calculating a new total engine speed fluctuation;

d.3 generating a fault code for the first fuel injector when the calculated engine speed fluctuations from steps (d.1) and (d.2) are equal;

d.4 repeating steps (d.1) through (d.3) for each remaining fuel injector.

40. The method of claim 38, wherein if the threshold conditions of claim 30 are satisfied a routine is performed to determine which ones of the plurality of fuel injectors are malfunctioning.

41. The method of claim 38, wherein if the threshold conditions of claim 30 are not satisfied a routine is performed to balance the cylinders.

42. The method of claim 37, further comprising performing the following steps if the engine speed fluctuations satisfy the threshold conditions in claim 37:

d.1 adjusting the trim for the first fuel injector and calculating the total engine speed fluctuation;

d.2 readjusting the trim for the first fuel injector until the calculated total engine speed fluctuation is at a local minimum;

d.3. repeating steps (d.1) through (d.2) for all fuel injectors.

43. The method of claim 42, wherein fault codes corresponding to adjustments made to each of the injectors are generated.

* * * * *